US006081957A

United States Patent [19]

Webb

[11] Patent Number: 6,081,957

[45] Date of Patent: Jul. 4, 2000

[54] ELECTRONIC TOOTHBRUSH CONSTRUCTION

[76] Inventor: Herbert L. Webb, 2130 Catherine St., Philadelphia, Pa. 19146

[21] Appl. No.: 09/186,807

[22] Filed: Nov. 5, 1998

[51] Int. Cl.[7] ..... A46B 9/04

[52] U.S. Cl. ..... 15/105; 15/167.1

[58] Field of Search ..... 15/105, 167.1

[56] References Cited

U.S. PATENT DOCUMENTS

| | | | |
|---|---|---|---|
| 4,802,255 | 2/1989 | Breuer et al. | 15/207.2 |
| 5,331,707 | 7/1994 | Irizarry . | |
| 5,355,544 | 10/1994 | Dirksing . | |
| 5,438,726 | 8/1995 | Leite . | |
| 5,673,451 | 10/1997 | Moore et al. | 15/167.1 |
| 5,704,087 | 1/1998 | Strub . | |
| 5,876,207 | 3/1999 | Sundius et al. | 15/167.1 |
| 5,924,159 | 7/1999 | Haitin | 15/167.1 |

*Primary Examiner*—Robert J. Warden, Sr.
*Assistant Examiner*—Kaj K. Olsen
*Attorney, Agent, or Firm*—Henderson & Sturm LLP

[57] ABSTRACT

An electronic toothbrush construction 10 including a hollow toothbrush member 20 provided with a motion sensor 60 connected to a timer 40 which activates an LED indicator 43 after the motion sensor 60 detects movement of the toothbrush bristles 24 over a predetermined period of time. In addition, the toothbrush member 20 is further provided with a wear sensor 80 and a pressure sensor 70 which are both operatively associated with an alarm 50 and selected toothbrush bristles 24. The pressure sensor 70 will trigger an intermittent alarm signal when excess pressure is applied to the bristles 24 and the wear sensor 80 will trigger a continuous alarm signal when selected bristles 24 are worn down to the point that wear sensor rods 81 are exposed.

9 Claims, 1 Drawing Sheet

ELECTRONIC TOOTHBRUSH CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of toothbrush constructions in general, and in particular to an electronic toothbrush construction that detects both excessive pressure and wear and times the intervals during which the brushing motion of the toothbrush takes place.

2. Description of Related Art

As can be seen by reference to the following U.S. Pat. Nos. 5,331,707; 5,355,544; 5,438,726; and 5,704,087, both electronic time and pressure sensitive toothbrush constructions are well represented in the prior art.

While all of the aforementioned prior art constructions are more than adequate for the basic purpose and function for which they have been specifically designed, they are uniformly deficient with respect to their failure to provide a simple, efficient, and practical electronic toothbrush that combines both a timer, a pressure sensitive and a wear sensitive feature into the same toothbrush construction.

As most dental care providers are all too well aware, the three most important parameters in proper dental hygiene revolve around the user brushing their teeth for a minimum amount of time and pressure and also replacing the toothbrush at regular intervals so that the user is employing toothbrush bristles that are effective in performing their intended function.

As a consequence of the foregoing situation, there has existed a longstanding need for a new and improved electronic toothbrush that not only incorporates a timer function in the handle, but also has electronic wear sensors built into the bristles, and the provision of such a construction is a stated objective of the present invention.

BRIEF SUMMARY OF THE INVENTION

Briefly stated, the electronic toothbrush construction that forms the basis of the present invention comprises in general, a toothbrush unit and an electronic control unit disposed within the toothbrush unit and operatively associated with the bristles of the toothbrush unit.

As will be explained in greater detail further on in the specification, the toothbrush unit includes a hollow toothbrush member provided with a head portion equipped with a plurality of bristles.

In addition, the electronic control unit includes a motion sensor, a wear sensor, and a pressure sensor all of which are operatively associated with the toothbrush bristles. The motion sensor in turn activates a timer that is responsive to the motion of the bristles so that the timer only keeps track of the time that the bristles are actually in contact with the user's teeth.

Furthermore, both the wear sensor and the pressure sensor are operatively associated with an alarm that will provide the user with different signals that will indicate either excess pressure being applied on the bristles or the fact that the bristles have become worn down to the point that the toothbrush construction should be replaced.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
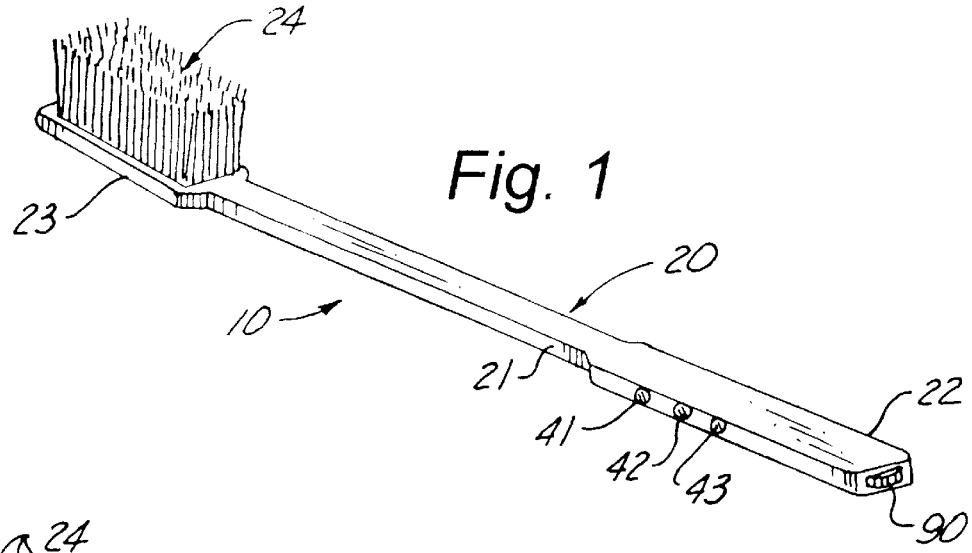
FIG. 1 is a perspective view of the electronic toothbrush that forms the basis of the present invention.

As can be seen by reference to the drawings, and in particularly to FIG. 1, the electronic toothbrush construction that forms the basis of the present invention is designated generally by the reference number 10. The construction 10 comprises in general, a toothbrush unit 11, and an internal electronic control unit 12. These units will now be described in seriatim fashion.

As can best be seen by reference to FIG. 1, the toothbrush unit 11 comprises a hollow toothbrush member 20 including an elongated handle portion 21 which is enlarged on one end 22 and which terminates on the other end in a hollow head portion 23 provided with a plurality of bristles 24 in a well recognized fashion.

Figure 2:
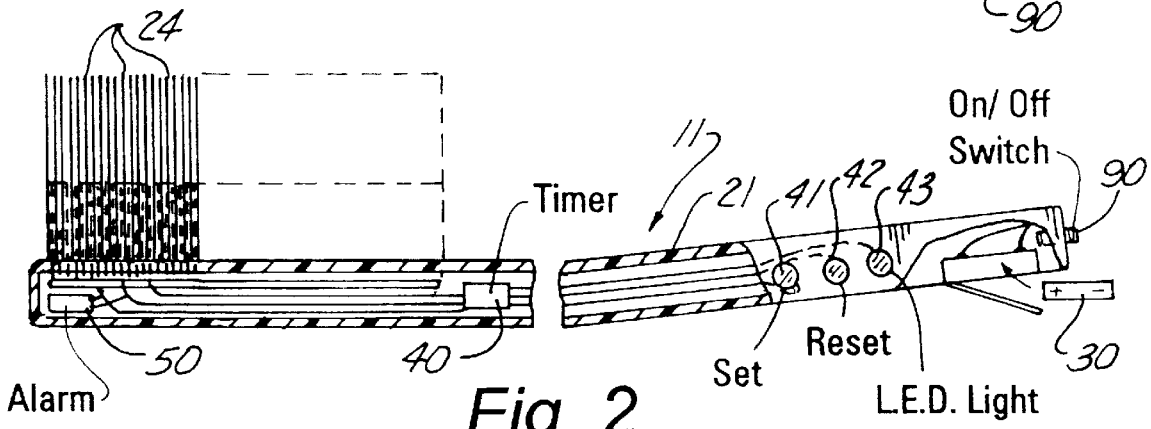
FIG. 2 is a cross sectional view of the toothbrush construction.
Figure 3:
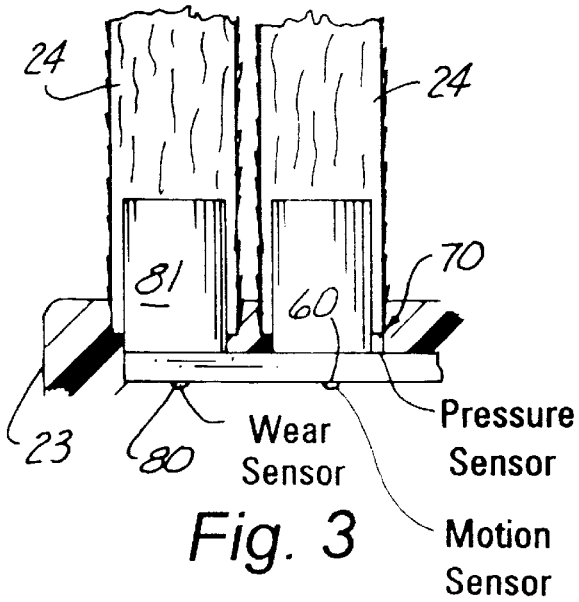
FIG. 3 is an isolated detailed cross sectional view of the bristles and head of the toothbrush prior to the replacement phase.
Figure 4:
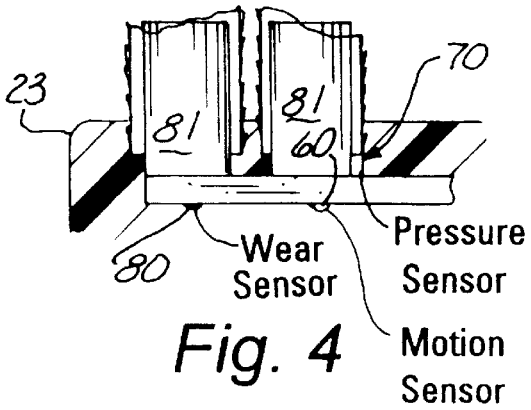
FIG. 4 is an isolated detailed cross sectional view showing the point when the bristles have worn down to the point that the wear sensor will be activated.

Turning now to FIGS. 2 through 4, it can be seen that the electronic control unit 12 comprises in general, a battery power source 30 electrically connected to a timer 40 and an alarm 50 which are responsive respectively to the output from a motion sensor 60, a pressure sensor 70 and a wear sensor 80.

In addition, the enlarged end 22 of the handle portion 21 of the handle member 20 is provided with a plurality of switches which include an on off switch 90 operatively associated with the power source 30 and a time set switch 41 and a time reset switch 42 operatively associated with the timer 40. Furthermore, the timer 40 is further operatively associated with an LED indicator 43 wherein the purpose and function of the timer associated switches 41, 42 and indicator light 43 will be explained shortly.

Turning now to FIGS. 3 and 4, it can be seen that the wear sensor 80 is operatively associated with a plurality of discrete wear sensor rods 81 which extend upwardly inside individual bristles 24 in the toothbrush head portion 23.

In operation, the user would activate the electronic control unit 12 by turning the on-off switch 90 to the "on" position to energize the control unit 12. The user would then hit the time set button 41 which would begin counting the elapsed time once the motion sensor 60 detects motion being transmitted through the bristles 24. The timer 40 would continue to run until such time as a predetermined period of brushing motion had elapsed such as three minutes, at which point the LED light 43 would be turned on to indicate that the desired minimum brushing duration had been achieved. Then when the user finishes brushing they would hit the reset button 42 to extinguish the LED indicator 43 and return the timer 40 to the null position until the user is ready to time his or her next brushing.

Again referring to FIGS. 2 through 4, it can be seen that the alarm 50 is operatively associated with both the wear sensor 80 and the pressure sensor 70 such that when the pressure sensor 70 detects an excessive downward pressure being exerted on the bristles 24, the alarm 50 will produce an intermittent signal indicating that condition until the downward pressure returns to acceptable levels. Furthermore, as shown in FIG. 4, when the bristles 24 have been worn down from repeated usage to expose the top of one or more of the wear sensor rods 81, the alarm 50 will be activated to generate a continuous alarm signal to notify the user that it is time to replace the toothbrush construction 10.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. An electronic toothbrush construction comprising:

a toothbrush unit including a hollow toothbrush member having a handle portion having an enlarged end wherein the other end terminates in a hollow head portion equipped with a plurality of bristles; and an internal control unit disposed within the hollow toothbrush member and including a power source connected to means for sensing the movement of said bristles, means for sensing the wear on said bristles, and means for sensing pressure exerted on said bristles wherein the means for sensing the wear on said bristles includes a wear sensor provided with a plurality of wear sensor rods wherein each wear sensor rod projects upwardly into a selected one of said plurality of bristles; said means for the movement of said bristles is mounted on the wear sensor and the means for sensing pressure on said bristles is disposed both adjacent at least one of said wear sensor rods and intermediate wear sensor and the bristle associated with the at least one of said wear sensor rods.

2. The construction as in claim 1 further comprising:

a timer operatively associated with said means for sensing the movement of said bristles wherein the timer is actuated in response to the movement of said bristles.

3. The construction as in claim 2 further comprising:

indicating means operatively associated with both said timer and said means for sensing the motion of the bristles for indicating when said bristles have been in motion for a predetermined elapsed period of time.

4. The construction as in claim 1 further including:

alarm means operatively associated with said means for sensing the pressure exerted on said bristles for generating a first signal in response to excess pressure being exerted on said bristles.

5. The construction as in claim 4 wherein said alarm means are also operatively associated with said means for sensing the wear on said bristles for generating a second signal in response to excess wear being sensed on said bristles.

6. The construction as in claim 5 wherein said first and second signals are different.

7. The construction as in claim 5 wherein said first signal comprises an intermittent signal.

8. The construction as in claim 7 wherein said second signal comprises a continuous signal.

9. The construction as in claim 5 wherein said wear sensor is operatively associated with said power source and said alarm.

* * * * *